United States Patent [19]

Mulligan

[11] 4,270,233

[45] Jun. 2, 1981

[54] OBSTETRIC BED

[76] Inventor: Jack E. Mulligan, 6199 Bermuda Dr., St. Louis, Mo. 63135

[21] Appl. No.: 12,570

[22] Filed: Feb. 15, 1979

[51] Int. Cl.[3] ..... A61G 7/00
[52] U.S. Cl. ..... 5/68; 269/325
[58] Field of Search ..... 5/66, 67, 68, 63, 60; 269/325, 328, 324

[56] References Cited

U.S. PATENT DOCUMENTS

| | | | |
|---|---|---|---|
| 2,712,484 | 7/1955 | Adolphson . | |
| 3,012,253 | 12/1961 | Reichert | 5/68 |
| 3,177,503 | 4/1965 | Black et al. | 5/68 |
| 3,309,717 | 3/1967 | Black | 5/68 |
| 3,486,747 | 12/1969 | Cardoso | 269/325 |
| 3,722,010 | 3/1973 | Saternus | 5/66 |
| 3,886,610 | 6/1975 | Shelden | 5/465 |
| 3,919,727 | 11/1975 | Paine | 5/66 |
| 4,097,939 | 7/1978 | Peck et al. | 5/66 |

OTHER PUBLICATIONS

Ohio-Scanlan Model No. A-6000, pp. 18-21, received on 7/13/48.
Ohio-Scanlan Model No. A2148J.

*Primary Examiner*—Alexander Grosz
*Attorney, Agent, or Firm*—Senniger, Powers, Leavitt and Roedel

[57] ABSTRACT

An obstetric bed comprising a base and a support structure on top of the base for supporting a patient. The support structure has a body section secured to the base in a generally horizontal position, a head section pivoted to the head end of the body section for swinging between a first position in which it extends horizontally outwardly from the body section and a second position in which it is inclined with respect to the body section, and a foot section pivoted to the foot end of the body section for swinging between a first position in which it extends horizontally outwardly from the body section and a second position in which it extends vertically down from the body section at the foot end of the base. Mechanism is provided for holding the head and foot sections in various positions of adjustment.

15 Claims, 19 Drawing Figures

OBSTETRIC BED

BACKGROUND OF THE INVENTION

This invention relates to an improved obstetric bed, and more particularly to an adjustable bed of this class. Reference may be made to U.S. Pat. No. 2,712,484 disclosing a physician's examining table generally in the field of this invention.

SUMMARY OF THE INVENTION

Among the several objects of this invention may be noted the provision of an improved obstetric bed which is quickly and easily adjustable for providing a doctor (or midwife) ready access to a patient on the bed about to give birth; the provision of such a bed which is adjustable to selected positions for maximizing patient comfort; the provision of such a bed which is readily convertible into a delivery table; the provision of such a bed which is mobile and readily maneuverable for convenient movement of the bed from one place to another; the provision of such a bed which incorporates a large storage area for hospital accessories, a patient's belongings, etc.; the provision of such a bed which is stably supported; the provision of such a bed which is lightweight and compact in design; and the provision of such an obstetric bed which is pleasing in appearance, safe to use and economical to produce.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
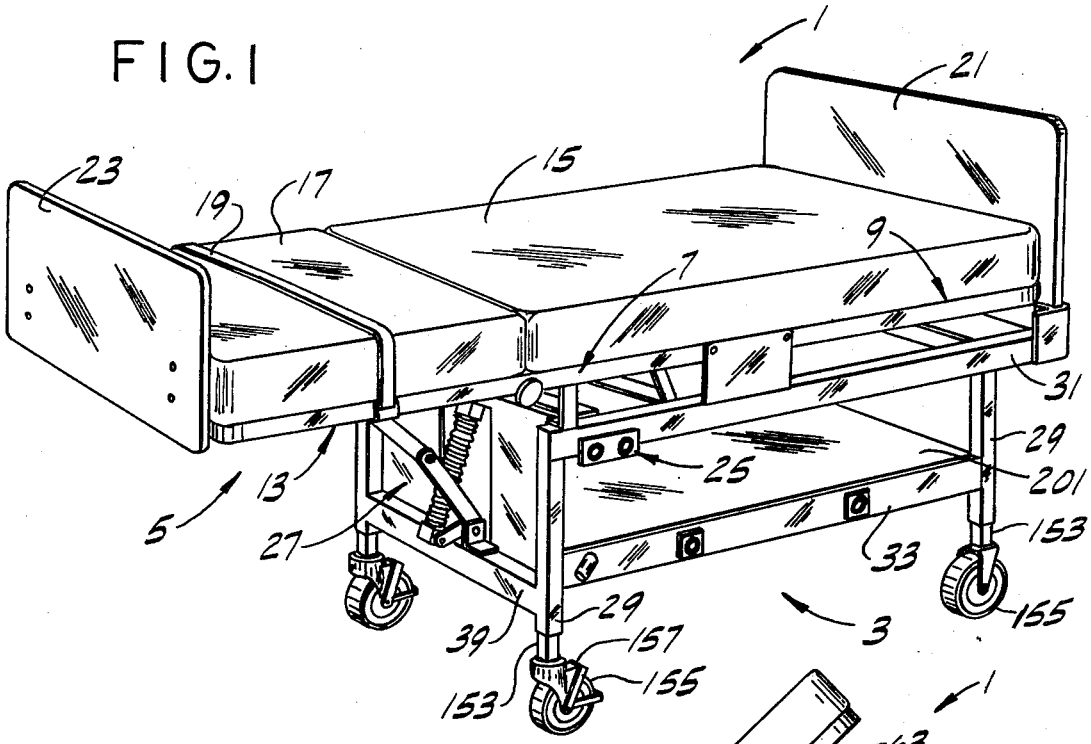
FIG. 1 is a perspective of an obstetric bed of this invention comprising a base and a support structure on the base having head, body and foot sections, all of which sections are shown in a generally horizontal position.
Figure 2:
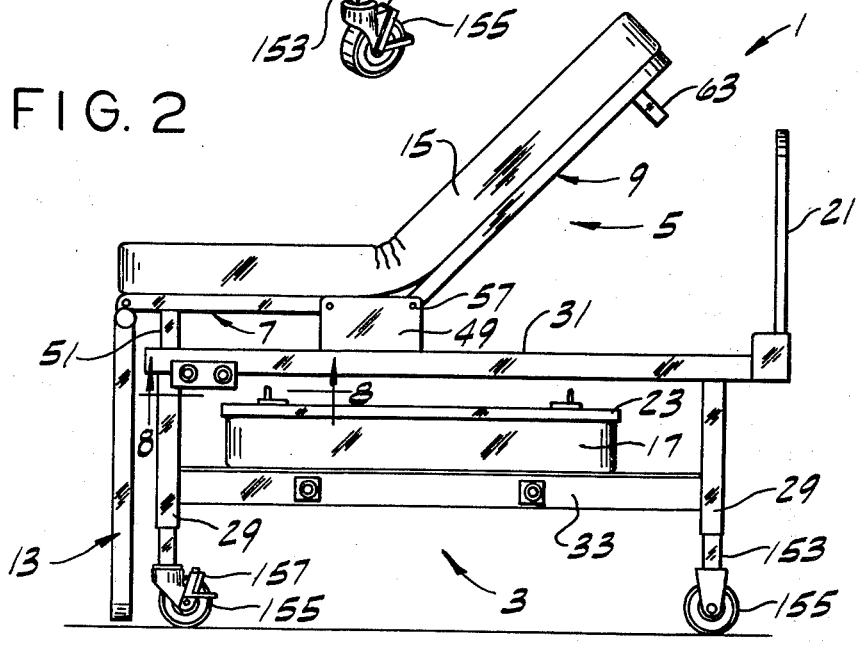
FIG. 2 is a side elevation of FIG. 1 with the head section of the support structure shown in a inclined position and the foot section in a vertical position.

Referring now to the drawings, first more particularly to FIGS. 1 and 2, an obstetric bed of this invention is designated in its entirety by the reference numeral 1 and is shown to comprise a base indicated generally at 3, and a support structure or frame, generally designated 5, on top of the base for supporting a patient. This support structure 5 has a body section, generally indicated at 7, rigidly secured to the base in a generally horizontal position, and a head section, generally designated 9, pivotally connected to the head end (the right end as viewed in FIGS. 1 and 2) of the body section for swinging on the body section about an axis extending transversely of the support structure between a first position (FIG. 1) in which it extends horizontally outwardly from the body section and a second position (FIG. 2) in which it is inclined upwardly with respect to the body section. The support structure also includes a foot section generally indicated at 13 pivotally connected to the foot (left) end of the body section 7 for swinging on the latter about an axis extending from one side of the support structure to the other between a first position (shown in FIG. 1) in which it extends generally horizontally to the left beyond the foot end of the base 3 and a second position (shown in FIG. 2) in which it extends generally vertically downwardly from the body section 7 at the foot end of the base. As shown, a two-piece mattress is supported on the support structure 5, one piece 15 of the mattress being relatively long and resting atop the head and body sections 9, 7 of the support structure, and the other piece 17 being shorter and secured by a strap 19 to the foot section 13. Removable head and foot boards indicated at 21 and 23 are provided at respective ends of the support structure 5.

Indicated generally at 25 is means for swinging the head section 9 between its inclined and horizontal positions and for holding it in selected positions of adjustment between those positions. And indicated generally at 27 is means for swinging the foot section 13 between its horizontal and vertical positions and for holding that section in selected positions of adjustment therebetween.

Figure 4:
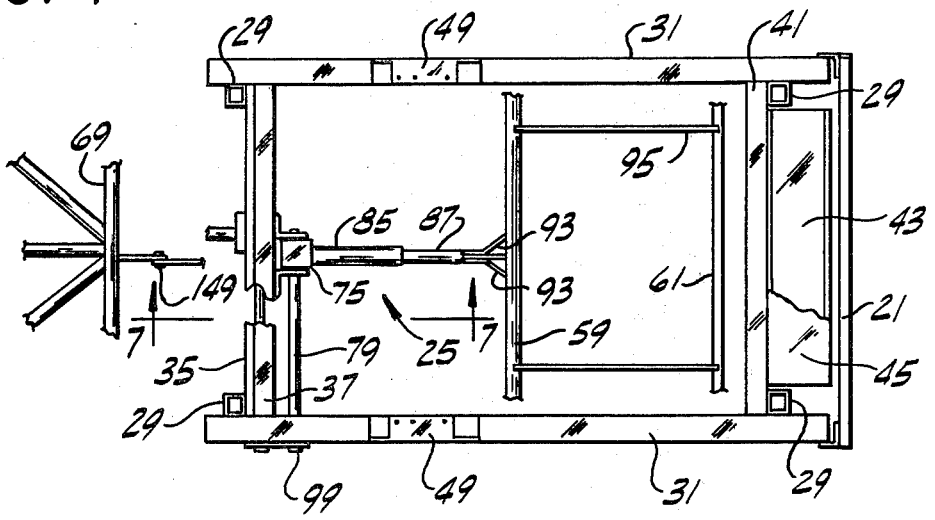
FIG. 4 is a plan of portions of the support structure and the upper part of the base.
Figure 5:
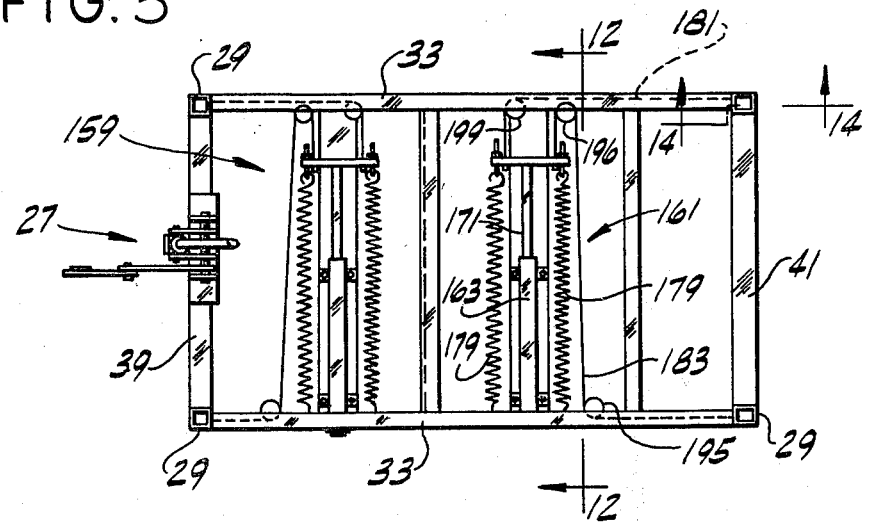
FIG. 5 is a plan of the lower part of the base.

More particularly, the base 3 is shown in FIGS. 2, 4 and 5 as comprising four vertical posts, each designated 29, at the corners of the base and a pair of side rails 31, one at each side of the base, extending lengthwise of the base and connecting the upper ends of the posts 29. Spaced below these side rails 31 and extending generally parallel thereto between the vertical posts, is a second pair of lower side rails, each of these latter rails being designated 33. The base further includes two crossbars 35, 37 both generally L-shaped in section (FIG. 7), connecting the upper ends of the two posts 29 at the foot end of the base, and another crossbar 39 connecting the posts at their lower ends. The posts at the head (right) end of the base are connected at their upper and lower ends by a pair of crossbars, each designated 41. As best shown in FIG. 4, an upwardly facing channel 43 extending transversely of the base is rigidly secured (as by welding) to the upper crossbar 41 between the latter and the headboard 21. This channel 43 is filled with lead or other suitably heavy material to weight the head end of the base so as to stabilize the bed and prevent tipping of the bed in the event a strong downward force is exerted on the outer end of the foot section of the support structure. The channel 43 has a cover 45 secured to it.

Figure 3:
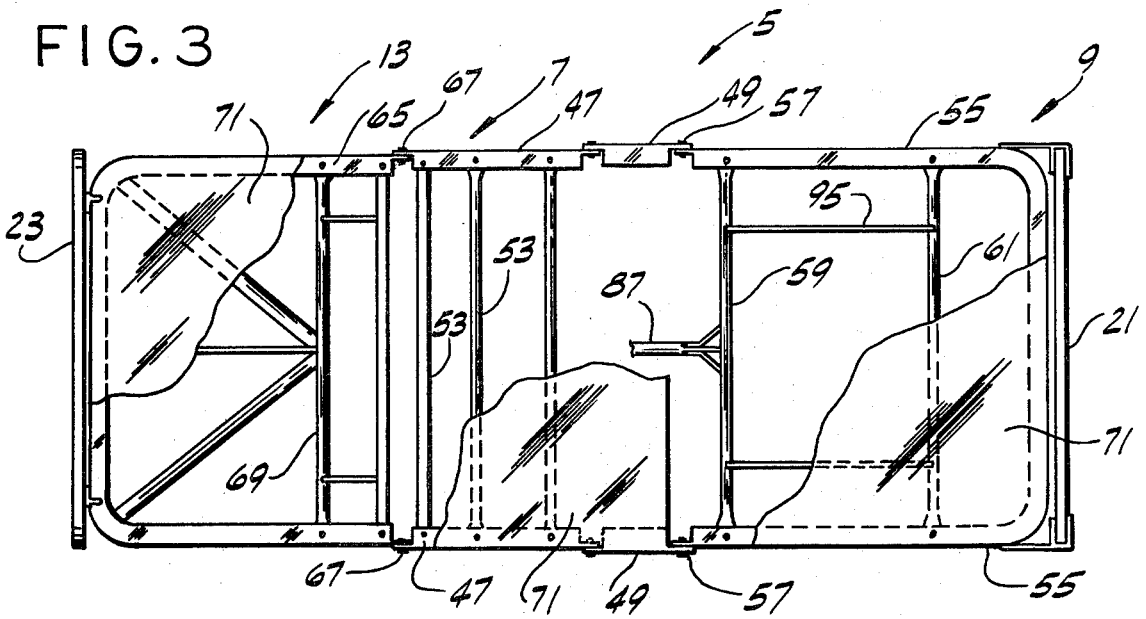
FIG. 3 is a plan of the support structure with portions broken away for clarity.

As stated above, the support structure 5 of the bed comprises head, body and foot sections indicated at 9, 7 and 13, respectively. The body section 7 is shown in FIGS. 2 and 3 as including a pair of side bars, each designated 47, spaced above and parallel to the upper side rails 31 of the base. Each of these side bars 47 is rigidly secured (e.g., riveted) at its head (right) end to a support plate 49 mounted atop a respective side rail 31, and at its foot (left) end to an angle iron 51, also mounted on side rail 31. The body section 7 further comprises several (three, for example) cross support members 53 extending between the side bars 47 from one side of the support structure to the other.

The head section 9 comprises a one-piece, generally U-shaped bar 55 pinned at each of its ends as indicated at 57 to a support plate 49 of the body section for pivoting on the body section between its aforesaid horizontal and inclined positions. Two parallel cross support members designated 59 and 61 extend transversely of the support structure between opposite sides of the U-shaped bar 55, and a pair of legs 63 extending down from the bar 55 at each of its sides are engageable with the side rails 31 of the base for supporting the head section in a generally horizontal position.

The foot section 13 of the support structure is also formed by a generally U-shaped bar 65, the latter being pin-connected at its ends at 67 to the foot end of the side bars 47 of the body section for swinging between its horizontal position (FIG. 1) and its vertical position (FIG. 2). Extending from one side of the support structure to the other between opposite legs of U-bar 65 are two spaced-apart parallel support members 69. Three separate mattress-supporting sheets 71 of stainless steel, for example, are connected to side bars 47 of the body section of the support structure and to the U-shaped bars 55, 65 of the head and foot sections.

Means 25 for swinging the head section 9 between its horizontal and inclined positions is shown best in FIGS. 4, 6 and 7 as comprising a screw shaft 73 extending generally in the central vertical longitudinal plane of the bed immediately below the body section 7 of the support structure 5. One end of this screw shaft 73 (its left end as viewed in the drawings) is journalled in a wall of a gear box 75 pivotally mounted on a reduced-end portion 77 of an input shaft 79 extending generally transversely of the base adjacent upper crossbar 37 at the foot end of the base. Keyed on the left end of this screw shaft, which projects inside the gear box 75, is a bevel gear 81 which meshes with another bevel gear 83 on the reduced-end portion 77 of the input shaft.

Means 25 further comprises a guide tube 85 of circular section fastened to the gear box and surrounding the screw shaft 73. A tubular actuating arm 87, also circular in section, is slidably received inside this guide tube and has an insert 89 secured in its inner (left) end. This insert 89, which has a tapped bore through it, is threaded on the screw shaft 73 which extends coaxially of the actuating arm 87. The outer (right) end of arm 87 is pinned at 91 to a pair of bars, each designated 93, angling downwardly from cross support member 59 of the head section 9 of the support structure. A brace 95 connects the lower end of these bars to cross support member 61 of the head section.

Figure 6:
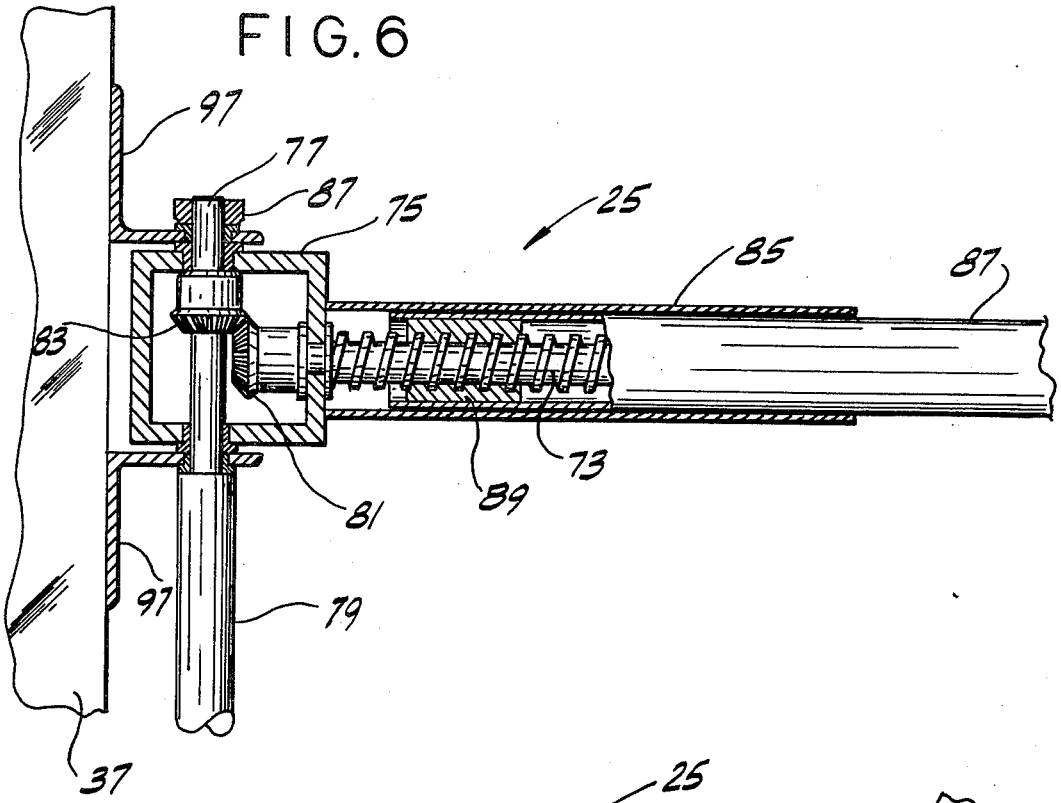
FIG. 6 is an enlarged portion of FIG. 4 with portions broken away and shown in section to illustrate details.
Figure 7:
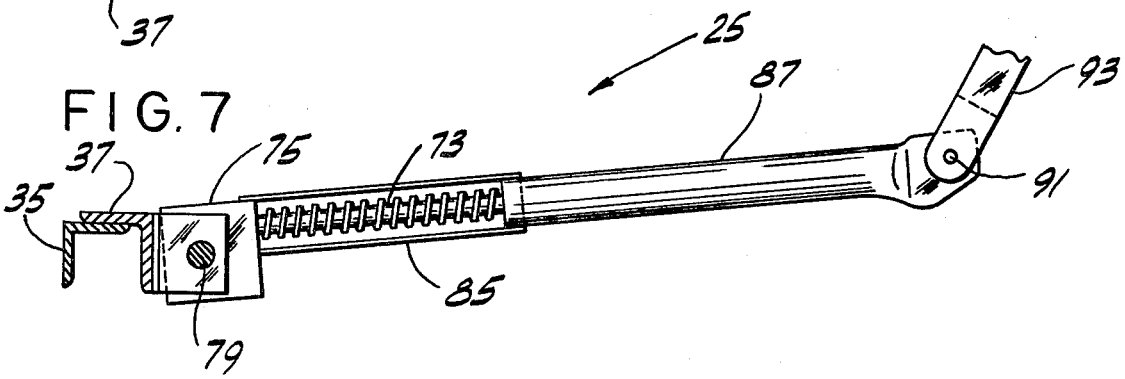
FIG. 7 is a section taken on line 7—7 of FIG. 4.
Figure 8:
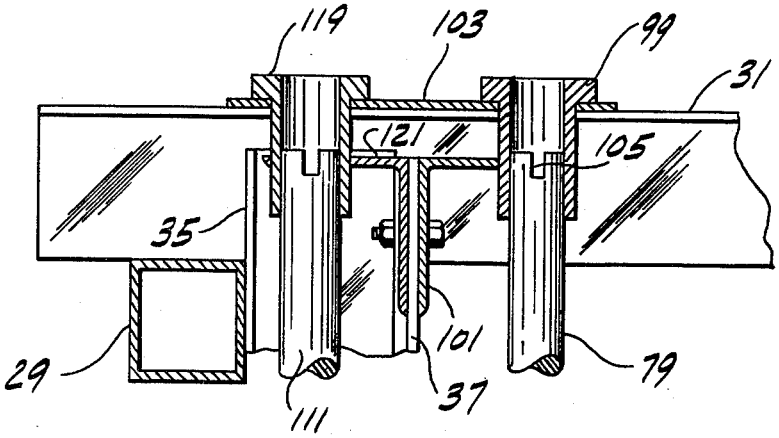
FIG. 8 is a section taken on line 8—8 of FIG. 2.

The reduced-end portion 77 of the input shaft 79 on which the gear box 75 is pivoted is shown in FIG. 6 to be rotatably mounted on a pair of L-shaped mounting plates 97 secured, as by welding, to upper crossbar 37 at the foot end of the base. A collar 87 on the end of the input shaft maintains the shaft in position. The other end of the input shaft 79 is journaled in a bearing 99 (FIG. 8) supported by a bracket 101 bolted to upper crossbar 37 and a journal plate 103 fixed (e.g., welded) on the outside of side rail 31. As indicated at 105, this end of the shaft 79 is slotted for receiving the end of a crank handle to manually rotate the input shaft about its axis.

The head section 9 of the support structure 5 may be raised from a horizontal to an inclined position by turning the input shaft 79 in the appropriate direction. This causes, via bevel gears 81 and 83, the screw shaft 73 to rotate about its longitudinal axis and the threaded insert 89 to travel to the right (as viewed in FIGS. 6 and 7) along the screw shaft thereby forcing the actuating arm 87 to slide axially in the guide tube 85 to an extended position (FIG. 7). This in turn forces the head section to pivot about its pin connections 57 and to swing up toward its fully inclined position shown in FIG. 2. Reverse rotation of the input shaft causes the actuator arm 87 to slide to the left in guide tube 85 toward a retracted position (FIG. 6) to lower the head section toward its horizontal position. As the arm 87 slides in tube 85 to swing the head section about its axis, the gear box 75 pivots on the reduced end portion 77 of the input shaft. Thus, it will be apparent that the head section 9 of the support structure 5 can be swung to any desired angle of inclination by turning the input shaft 79 by means of a crank handle the appropriate number of revolutions in the appropriate direction. And the arrangement is such that the head section is securely held in its adjusted position until the input shaft is again rotated via the crank handle.

Figure 10:
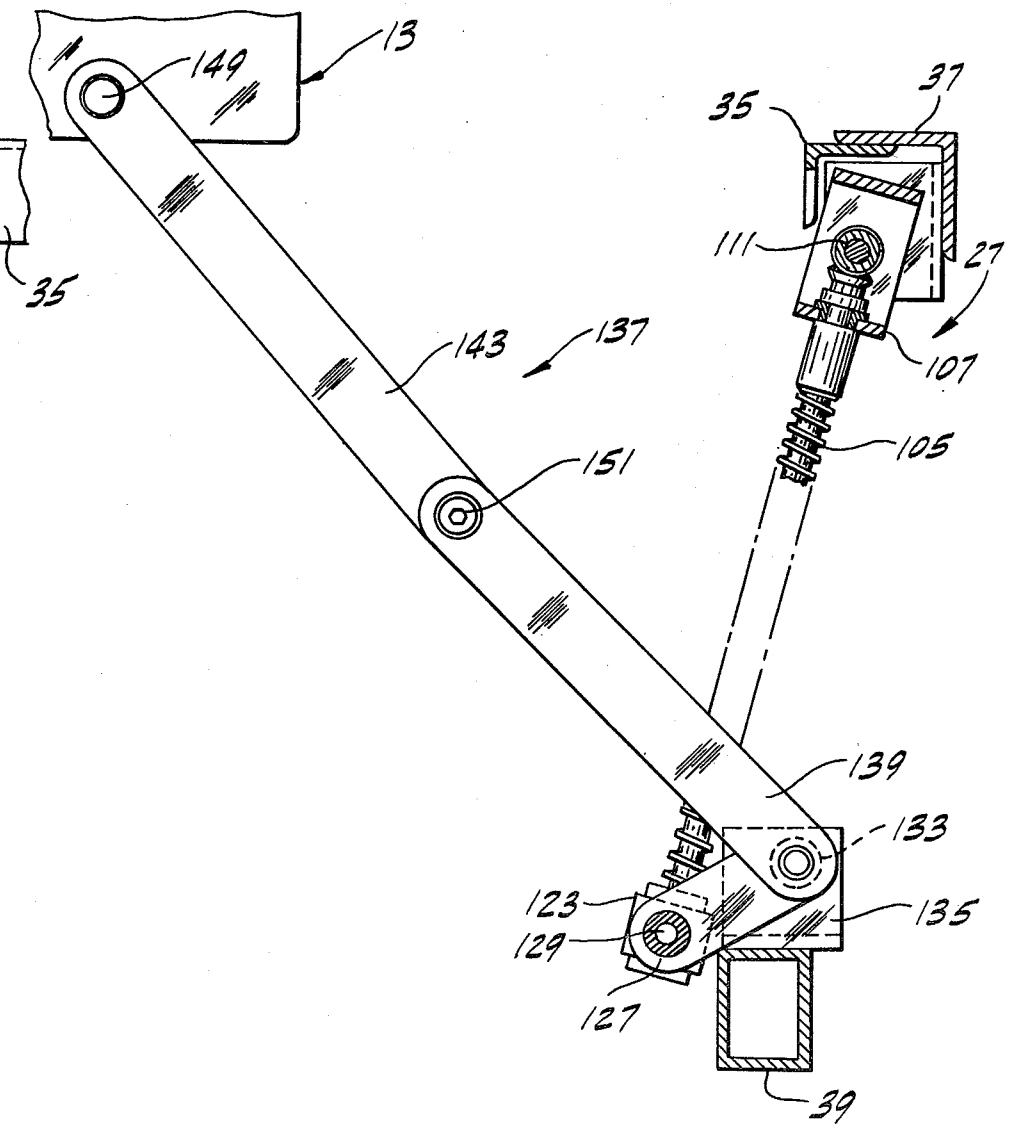
FIG. 10 is a side elevation of FIG. 9 with portions shown in section.
Figure 9:
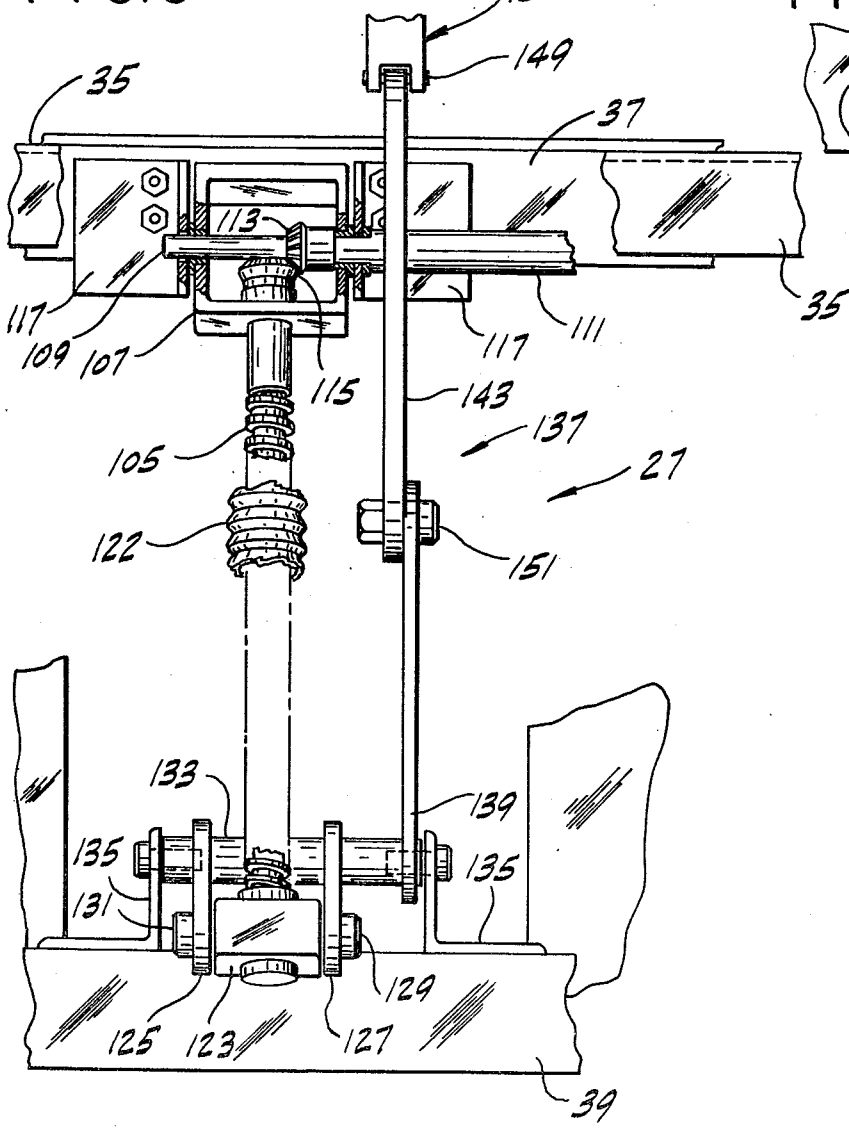
FIG. 9 is an elevation of means at the foot end of the base for swinging the foot section between horizontal and vertical positions and holding it in selected positions of adjustment therebetween.
Figure 11:
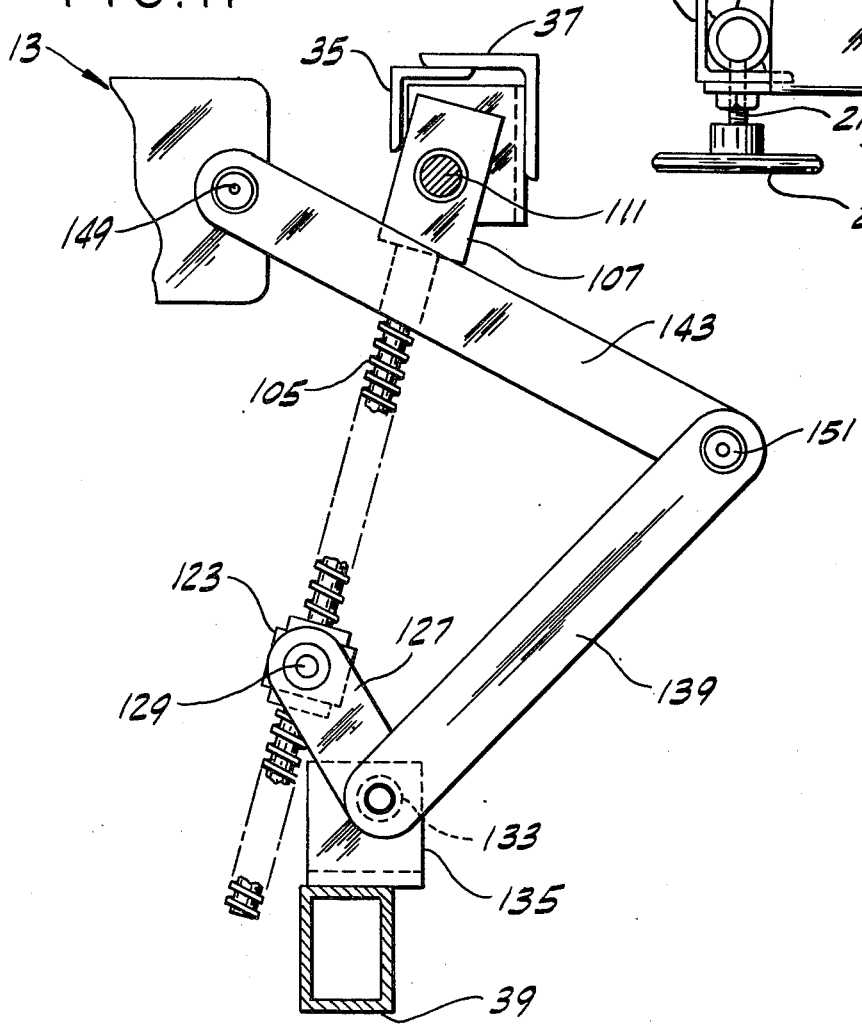
FIG. 11 is a view similar to FIG. 10 showing the aforesaid swinging means in a different position.

Means 27 for swinging the foot section 13 of the support structure 5 between its horizontal and vertical positions is shown in FIGS. 9–11 as being located at the foot end of the base and as comprising a screw shaft 105 (similar to screw shaft 73) lying in a generally vertical plane extending longitudinally of the bed and having its upper end journalled in a wall of a gear box 107, the latter of which is pivotally mounted on a reduced-end portion 109 of an input shaft 111 extending generally parallel to input shaft 79 between the upper crossbars 35, 37 at the foot end of the base. The reduced-end portion 109 of this input shaft, which carries a bevel gear 113 adapted to mesh with a similar gear 115 on the upper end of the screw shaft 105, is mounted for rotation about its axis by a pair of angles, each designated 117, fastened to the vertical leg of crossbar 37. The opposite end of the input shaft, which is also slotted to receive a crank handle, is journalled in a bearing 119 supported by journal plate 103 and a bracket 121 secured to crossbar 37.

Threaded on the lower end of screw shaft 105, which shaft is enclosed by a flexible cover 122, is an output or follower nut 123 having two links 125, 127 pinned at their ends at 129, 131, respectively, to opposite sides of the nut for pivoting on the nut about an axis extending generally perpendicularly to the screw shaft 105. These links 125, 127 are rigidly secured (as by welding, for example) at their other ends to a pin 133 mounted on the base for rotation about an axis extending from side-to-side of the base. More specifically, the pin 133 is rotatably mounted on a pair of angles, each designated 135, affixed to the top of the lower crossbar 39 at the foot of the base.

Means 27 further includes a linkage, generally designated 137, interconnecting pin 133 and the foot section 13 of the support structure 5 and lying generally in the central vertical longitudinal plane of the bed. This linkage comprises two links designated 139 and 143, the first of which is welded or otherwise rigidly secured to pin 133 to the right (as viewed in FIG. 9) of link 127 and extends from the pin generally perpendicularly with respect to link 127. The second link, link 143, is pivotally connected at one end at 149 to the foot section 13 of the support structure and at its other end at 151 to the outer end of link 139.

The foot section 13 of the support structure 5 may be swung from its horizontal (FIG. 1) to its vertical (FIG. 2) position by turning the input shaft 111 in the appropriate direction. This causes, via bevel gears 113 and 115, the screw shaft 105 to rotate about its longitudinal axis and the output nut 123 to travel upwardly on the shaft from the position shown in FIGS. 9 and 10 to the position shown in FIG. 11, thereby rotating, via links 125 and 127, pin 133 and link 139 of linkage 137 in the clockwise direction. As link 139 rotates about the axis of pin 133 in a clockwise direction, the link 143 connecting link 139 and the foot section of the bed pivots in a counterclockwise direction relative to link 139 about pin connection 151 to pull the foot section 13 down toward its vertical position. Reverse rotation of the input shaft 111 causes the output nut 123 to travel downwardly on screw shaft 105 and links 125, 127 and 139 to rotate about the axis of pin 133 in a counterclockwise direction. This causes link 143 to pivot in a clockwise direction relative to link 139 so that linkage 125, in effect, "straightens out" for swinging the foot section up toward its horizontal position. As the output nut 123 travels along the screw shaft 105, the gear box 107 pivots on the reduced-end portion 109 of the input shaft 111.

Thus, the foot section 13 of the support structure 5 can be swung to any desired position between its horizontal and vertical positions by turning the input shaft 111 (via a crank handle) the appropriate number of revolutions in the appropriate direction. And the arrangement is such that the foot section is held in its adjusted position until the input shaft is again rotated.

As shown in FIG. 1, the base 3 of the obstetric bed is supported on a plurality of legs (e.g., four legs), each designated 153, having casters 155 at their lower ends for providing ready maneuverability to the bed. The casters on the two legs at the foot end of the bed incorporate foot brakes 157. The legs, which are tubular and generally square in section, are slidably received inside the posts 29 at the corners of the bed, and, in accordance with this invention, the base 3 is vertically adjustable with respect to the legs for selectively varying the elevation of the base and the support structure.

Means for raising and lowering the base on the legs and holding it as its adjusted elevation is shown in FIG. 5 to comprise two height-adjustment assemblies 159, 161, mounted side-by-side on the base and extending between the lower side rails 33 of the base. The assembly 159 shown on the left functions to adjust the elevation of the foot (left) end of the base, and the assembly 161 shown on the right functions to adjust the elevation of the head (right) end of the base. The fact that the elevation of one end of the bed may be adjusted independently of that of the other end is advantageous during certain types of operations, such as heart surgery.

Figure 12:
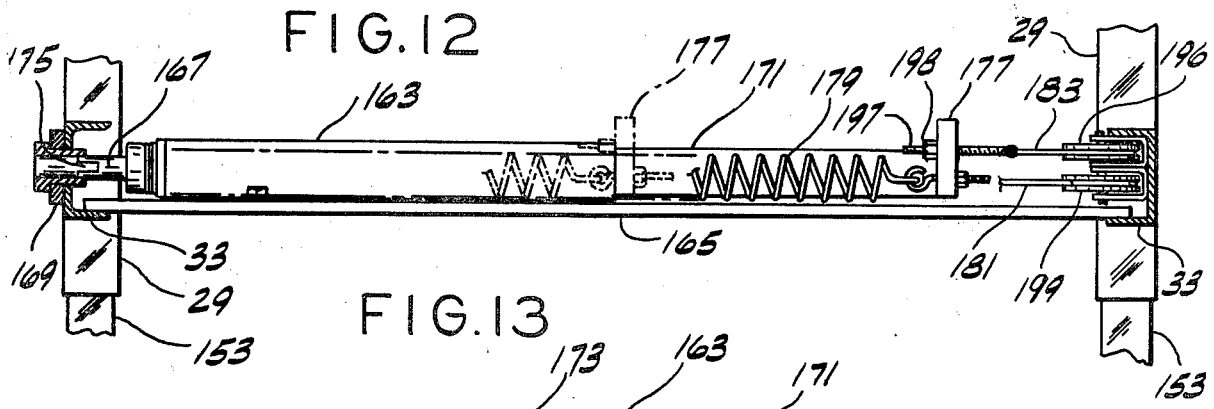
FIG. 12 is a section on line 12—12 of FIG. 5.
Figure 13:
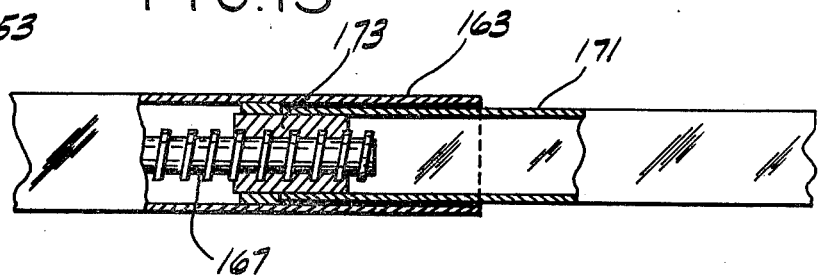
FIG. 13 is an enlarged portion of FIG. 12 with portions removed to illustrate details.

Inasmuch as the height-adjustment assemblies 159, 161 are identical in construction and operation, only the assembly 161 for adjusting the elevation of the head end of the bed will be described in detail. As shown in FIGS. 12 and 13, this assembly comprises a tubular guide 163 of square cross section mounted atop a cross piece 165 extending transversely of the base between the bottom side rails 33. A screw shaft 167 journalled at one end (its left end as viewed in FIG. 12) in a bearing 169 mounted in the bottom side rail 33 at the left of the base extends inside this tubular guide 163 and is generally coaxial with the guide. Axially slidable in the guide and indicated at 171 is an actuating arm of square-tube bar stock having an insert 173 secured therein at its left end. This insert 173, which has a tapped bore extending axially through it, is threaded on the screw shaft 167, the arrangement being such that when the screw shaft is rotated in one direction, the actuating arm 171 slides in the guide 163 toward an extended position (shown in solid lines in FIG. 12), and when rotated in the other direction, the arm moves toward a retracted position (shown in phantom). In this regard, it will be noted that the left end of the screw shaft 167 is slotted as indicated at 175 for receiving the end of a crank handle to rotate the shaft. An elongate actuator plate 177 lying in a vertical plane extending longitudinally of the base is secured to the right end of actuating arm 171, and a pair of coil springs, each designated 179, connecting this plate and the bottom side rail 33 at the left (as viewed in FIG. 12) side of the base biases the arm toward its retracted position (i.e., toward the left).

Figure 14:
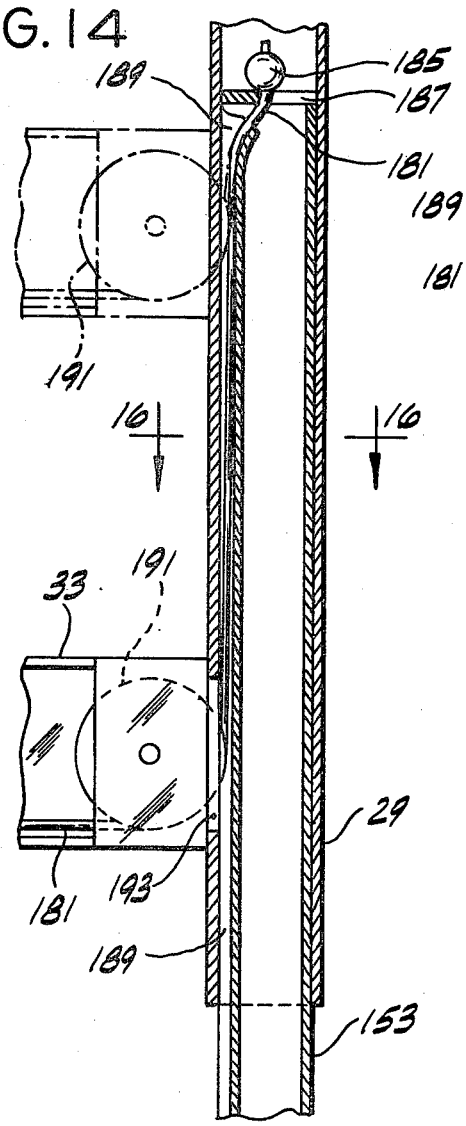
FIG. 14 is a section on line 14—14 of FIG. 5.
Figure 16:
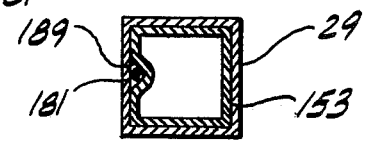
FIG. 16 is a section on line 16—16 of FIG. 14.
Figure 15:
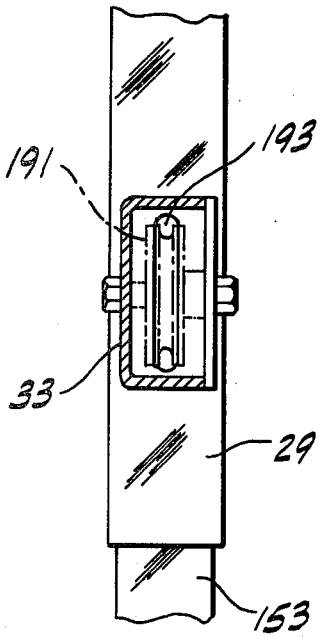
FIG. 15 is a left end elevation of FIG. 14.

Assembly 161 further comprises a first cable 181 attached to the upper end of one leg 153 at the head end of the base and extending therefrom along a route to be hereinafter described to the actuator plate 177 for securement thereto toward one end of the plate, and a second cable 183 attached to the upper end of the other leg 153 at the head end of the base and extending from that leg to the actuator plate where it is secured to the opposite end of the plate. More specifically, each of these cables 181, 183 is attached to the top of a respective leg by means of a metal ball 185 secured to the end of the cable and bearing against the closed top of the leg (FIG. 14). The cable extends through a slot 187 in the top of the leg and thence vertically downwardly in a groove 189 in a side of the leg to a wheel 191, peripheral portions of which project into the post 29 through a vertical slot 193 in one side of the post. The wheel 191 is pinned to a respective bottom side rail 33 for rotation about a horizontal axis extending transversely of the base.

From their respective wheels 191, each cable 181, 183 follows a different route to the actuator plate 177. Thus, as shown in FIG. 5, cable 183 extends generally horizontally alongside a bottom side rail 33 toward the foot end of the base to a wheel 195 mounted on the side rail for rotation about a vertical axis. The cable is trained around this wheel and from their extends horizontally toward the bottom side rail 33 at the opposite side of the base to another wheel 196 mounted on that rail, also for rotation about a vertical axis. The cable reverses its direction around this latter wheel 196 and extends to the actuator plate for connection thereto. In this latter regard, the cable may be attached to a threaded stud 197 extending through a bore in the plate and having a nut 198 threaded thereon.

Cable 181, on the other hand, extends from its respective wheel 191 generally horizontally along the bottom side rail at that side of the base toward the foot end of the base to a wheel 199 pinned to the side rail for rotation about a vertical axis. As best shown in FIG. 12, this latter wheel 199 is mounted on the bottom side rail 33 at a lower elevation than wheel 196 so as to enable the cable 181 to freely pass beneath the wheel 196. Cable 181 is trained around wheel 199 and directed to the actuator plate 177 for connection thereto in the same manner described above in regard to cable 183.

The elevation of the head end of the base is accomplished by rotating the screw shaft 167 of assembly 161 in an appropriate direction thereby to effect movement of the actuating arm 171 between its aforesaid extended and retracted positions. This, in turn, effects lengthwise (axial) movement of the cable to either raise or lower the head end of the base on the two legs at that end of the base. For example, FIGS. 12 and 13 show the actuating arm fully extended. When the arm is in this position, the base is at its lowest elevation and the two legs 153 at the head end of the base extend their maximum distance up into their respective posts 29. To raise the head end of the base, the screw shaft 167 is rotated in the appropriate direction by means of a crank handle formed to fit into the slot 175 in the end of the screw shaft 167. This causes the actuating arm 171 to slide axially in the tube toward its retracted position (to the left as viewed in FIG. 12). Inasmuch as cables 181, and 183 are secured to the actuator plate at the end of the arm 171, they too are pulled to the left which results in upward movement of the head end of the base on its respective legs from the position shown in solid lines in FIG. 14 toward the position shown in phantom. In effect, the base is pulled up on the legs. Springs 179, which bias the actuating arm 171 to a retracted position, serve to facilitate raising the base and also to maintain it in its elevated position. To lower the base on the legs, the screw shaft 167 is rotated in reverse direction, causing the actuating arm 171 to move back toward its extended position. As the arm moves in that direction, the cables 181, 183 are paid out, allowing the base to slide down on the legs to a lower elevation. In the event the cables should stretch over a period of time, any resultant slack may be taken up by threading the nuts 198 up on studs 197.

Thus, the elevation of the head end of the bed may be readily adjusted by turning the screw shaft 167 of assembly 161 in the appropriate direction. And the arrangement is such that the base is held at its adjusted elevation until the shaft is again rotated. The construction and operation of height-adjustment assembly 159 for adjusting the elevation of the foot end of the bed is identical to that described above in regard to assembly 161.

A shelf 201 resting on the bottom side rails 33 and extending therebetween covers the height-adjustment assemblies 159, 161. This not only presents a more pleasing appearance for enhancing the attractiveness of the bed, but also encloses the assemblies for increased safety. Moreover, the foot piece 17 of the mattress and the footboard 23 may be stored on the shelf when removed from the foot structure. Other hospital accessories and patient belongings may also be stored on the shelf. The shelf is readily removable for allowing access to assemblies 159, 161.

Figure 17:
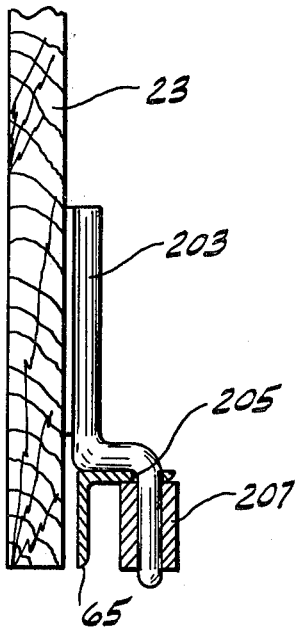
FIG. 17 is a view illustrating how a footboard is removably mounted on the foot section of the support structure.

As mentioned above, the footboard 23 of the bed is removable from the foot section 13 of the support structure 5. In this connection, two vertically-disposed mounting pins 203 (only one of which is shown in FIG. 17) fastened to one face of the footboard towards opposite ends of the latter extend down through openings 205 in the U-shaped bar 65 of the foot section 13 and into mounting tubes 207 secured to the bar. This construction provides for easy removal of the footboard from the support structure, as when the foot section is swung down to its vertical position for providing ready access by a doctor or midwife to an expectant mother, and also for quick and easy reattachment of the footboard to the support structure when the foot section is swung back up. The headboard 21 is also slidably removable from the base 3.

Figure 18:
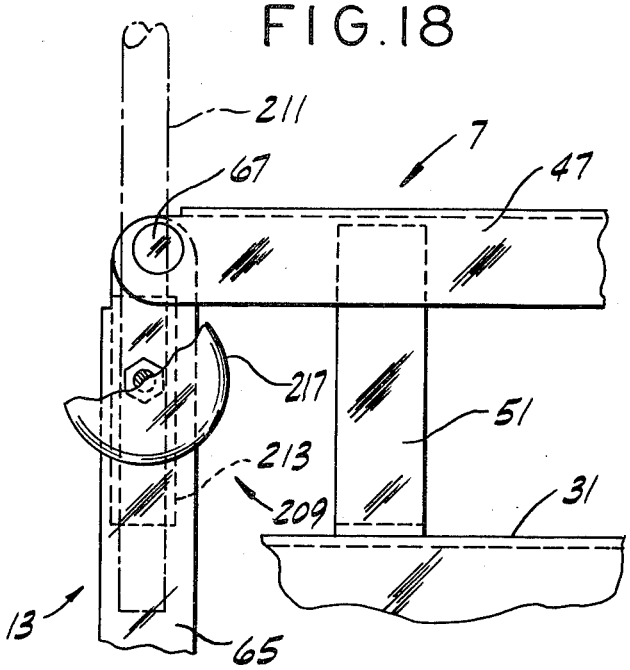
FIG. 18 is an enlarged portion of FIG. 2 showing means for securing a stirrup attachment to the obstetric bed.
Figure 19:
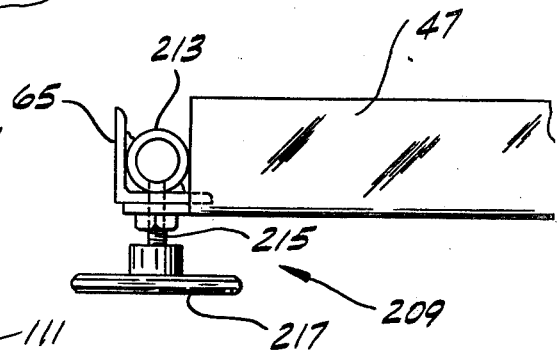
FIG. 19 is a plan of FIG. 18.

Means generally indicated at 209 is also provided at each side of the bed for holding a stirrup attachment 211 in generally vertically position when the foot section 13 of the support structure 5 is swung down to its vertical position. This means, as shown in FIGS. 17 and 18, comprises a guide tube 213 mounted on the inside of a respective leg of the U-shaped bar 65 of the foot section for slidably receiving the stirrup attachment 211. As shown, the axis of the tube extends generally parallel to the leg of the bar 65 so that with the foot section in its vertical position, the stirrup 211 extends vertically upwardly from the guide tube 213 above the support structure adjacent the foot end of the body section 7. Means 209 also includes a locking screw 215 and a knob 217 for locking the stirrup in the guide tube in a selected position of axial adjustment.

It is contemplated that a bed of this invention be used during the pre-delivery, delivery and recovery stages of the childbirth process, thus avoiding the inconvenience and discomfort of multiple transfers from one bed to a conventional delivery table, to a recovery bed, etc. In this connection, it will be apparent from the foregoing that the bed is quickly and easily adjustable for providing ready access by a doctor to an expectant mother lying on the bed. Thus, as hereinabove described, the foot section 13 of the support structure 5 may be swung from a horizontal to a vertical position and, if so desired, the footboard 23 and the foot piece 17 of the mattress removed from the foot section and stored on the shelf 201 on the base. The head section 9 of the support structure is readily adjustable for maximizing the comfort of the patient, and the height of the support structure may also be adjusted to a convenient working height for persons attending the patient. After examination or delivery has been completed, the foot section may be swung back up to its horizontal position or to some selected position between its horizontal and vertical positions, and the foot piece of the mattress and the footboard replaced on the foot section. If necessary, the obstetric bed may also be readily rolled from one place to another.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An obstetric bed comprising:

a base, a support structure on top of the base for supporting a patient, the support structure having a body section secured to the base in generally horizontal position, a head section pivotally connected to one end of the body section constituting its head end for swinging on the body section about an axis extending transversely of the support structure between a first position in which it extends generally horizontally outwardly from the body section and a second position in which it is inclined upwardly with respect to the body section, and a foot section pivotally connected to the other end of the body section constituting its foot end for swinging on the body section about an axis extending transversely of the support structure between a first position in which the foot section extends generally horizontally outwardly from the body section beyond one end of the base constituting the foot end of the base and a second position in which it extends generally vertically downwardly from the body section at the foot end of the base, means for holding the head section in its inclined position and in selected positions of adjustment between its inclined and horizontal positions, and means for swinging the foot section between its horizontal and vertical positions and for holding it in selected positions of adjustment therebetween, said swinging and holding means comprising a pin mounted on the base for rotation about the axis of the pin, the latter extending transversely with respect to the base, a linkage connected at one end to the foot section and at its other end, constituting its base end, to said pin for rotation of the base end of the linkage and said pin about said pin axis, and means for rotating the base end of the linkage about said pin axis whereby on rotation in one direction the foot section is raised toward its horizontal position and on rotation in the other direction the foot section is lowered toward its vertical position, said rotating means comprising a screw shaft mounted on the base at the foot end of the base for rotation about its longitudinal axis, said shaft lying in a generally vertical plane extending generally longitudinally of the base, a nut threaded on the screw shaft, and a link pinned at one end to the nut and rigidly secured at its other end to said pin whereby rotation of the screw shaft about its axis effects travel of the nut along the shaft to rotate the link, the pin and the base end of the linkage about the axis of the pin for swinging the foot section between its vertical and horizontal positions.

2. An obstetric bed as set forth in claim 1 wherein said linkage is pinned to the foot section for pivoting with respect to the latter about an axis extending generally transversely with respect to the support structure.

3. An obstetric bed as set forth in claim 1 wherein the base is adapted for rolling movement.

4. An obstetric bed as set forth in claim 1 wherein the base is supported on a plurality of legs and is vertically adjustable with respect to the legs for selectively varying the elevation of the support structure.

5. An obstetric bed as set forth in claim 4 wherein the base is mounted on the legs for vertical sliding movement on the legs.

6. An obstetric bed as set forth in claim 4 further comprising means for raising and lowering the base with respect to the legs to selected positions of vertical adjustment and then holding the base in its vertically adjusted position.

7. An obstetric bed as set forth in claim 6 wherein said means for raising and lowering the base and holding it in its vertically adjusted position comprises a cable attached to the upper end of a leg, means on the base for effecting axial movement of the cable, and means on the base for establishing a reach of cable extending vertically downwardly from the upper end of the leg alongside the leg and then generally horizontally to the cable-moving means whereby on movement of the cable in one direction the base is raised with respect to the leg and on movement of the cable in the opposite direction the base is lowered with respect to the leg.

8. An obstetric bed as set forth in claim 7 wherein said means for effecting movement of the cable comprises an arm having means at one end for securement of the cable to the arm, guide means on the base for guiding the arm, and means for moving the arm axially of the arm in the guide means to effect said movement of the cable to raise and lower the base.

9. An obstetric bed as set forth in claim 8 wherein said means for moving the arm comprises a screw shaft mounted on the base for rotation about its axis, the arm being mounted on the screw shaft for movement of the arm along the shaft in the guide means on rotation of the shaft thereby to effect said movement of the cable.

10. An obstetric bed as set forth in claim 9 wherein the screw shaft and arm are mounted transversely of the base.

11. An obstetric bed as set forth in claim 9 wherein said guide means comprises a generally tubular guide and said screw shaft extends generally coaxially within the guide, the arm being slidable in the guide between an extended position in which the base is in a lowered position with respect to the legs and a retracted position in which the base is in a raised position with respect to the legs.

12. An obstetric bed as set forth in claim 11 wherein said arm is biased toward its retracted position.

13. An obstetric bed as set forth in claim 7 wherein the means for establishing said reach of cable comprises a wheel mounted on the base adjacent said leg for rotation about an axis extending generally transversely with respect to the base.

14. An obstetric bed as set forth in claim 1 wherein the base is weighted toward its head end for stability.

15. An obstetric bed as set forth in claim 1 further comprising a headboard at the head end of the head section of the support structure and a footboard removably secured to the foot section at the foot end thereof.

* * * * *